United States Patent [19]

Taketa

[11] 4,044,506

[45] Aug. 30, 1977

[54] METHOD AND APPARATUS FOR REFACING AN ABRASIVE WHEEL

[76] Inventor: Jun A. Taketa, 2343 Fir St., Glenview, Ill. 60025

[21] Appl. No.: 681,449

[22] Filed: Apr. 29, 1976

[51] Int. Cl.[2] ..... B24B 53/04

[52] U.S. Cl. ..... 51/5 D; 51/92 R; 51/165.87

[58] Field of Search ..... 51/5 D, 165 R, 165.74, 51/165.75, 165.77, 165.8, 165.87, 165.88, 165.81, 92 R; 125/11 A

[56] References Cited

U.S. PATENT DOCUMENTS

| | | | |
|---|---|---|---|
| 2,390,967 | 12/1945 | Swenson | 51/165.81 |
| 2,632,433 | 3/1953 | Muench | 125/11.7 A |
| 3,636,636 | 1/1972 | Baldyga | 125/11 A |

*Primary Examiner*—Harold D. Whitehead

*Attorney, Agent, or Firm*—Dominik, Knechtel, Godula & Demeur

[57] ABSTRACT

A grinding wheel refacer for use in combination with grinding apparatus having an abrasive wheel, the refacer including mounting means for mounting and adjustably supporting a diamond bit with the grinding apparatus in refacing relationship with the abrasive wheel. A gauge assembly supporting a micrometer is removably affixed to the grinding apparatus in operative relationship with the diamond bit such that the diamond bit can be adjustably positioned to engage the micrometer means. The micrometer means is adjusted to establish a fixed determinable dimensional relationship with respect to a work piece to be ground on the grinding apparatus, and the diamond bit is adjustably positioned to engage the micrometer, to reface the abrasive wheel such that the radius of the peripheral face of the abrasive wheel corresponds to the finished dimension of the work piece.

3 Claims, 9 Drawing Figures

METHOD AND APPARATUS FOR REFACING AN ABRASIVE WHEEL

This invention relates to an improvement in a grinding wheel refacer.

Various types of devices have been proposed and utilized for refacing abrasive wheels, with varying degrees of success. The refacer of the present invention represents an improvement in abrasive wheel refacers. More particularly, the refacer can be used to dress an abrasive wheel in a manner far easier and quicker than most presently available types of refacers. Furthermore, the grinding of parts can be more accurately and consistently accomplished, from the first to the last piece to be ground, regardless of number of pieces required, using the refacer. Normally, in grinding of parts, it is only necessary to compensate for diamond wear on refacing the abrasive wheel. Further still, the abrasive wheel can be dressed without the necessity of removing the work from the chuck of the surface grinder. Accordingly, highly accurate and expeditious grinding operations are made possible by conveniently maintaining the grinding wheel surface clean and accurate in peripheral dimension.

Accordingly, it is an object of the present invention to provide an improvement in grinding wheel refacers.

The above and other objects and features of the invention will become more apparent from the following description and accompanying drawing wherein.

Figure 1:
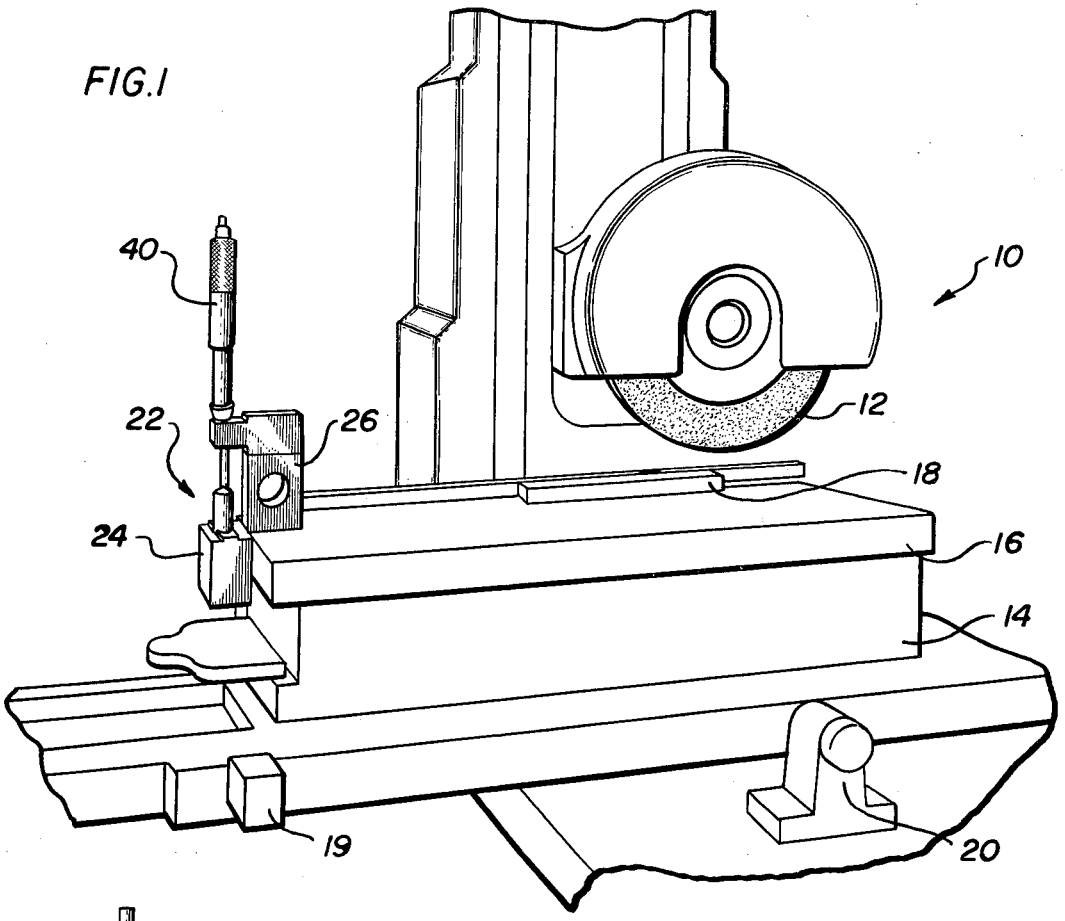
FIG. 1 is a partial perspective view of a surface grinder, illustrating the manner in which the refacer of the present invention is attached to and utilized with the surface grinder to reface the abrasive wheel thereof.

Referring now to the drawings, in FIG. 1 there is illustrated a surface grinder 10 which may be any one of a number of different commercially available surface grinders having an abrasive wheel 12, a work bed 14, and a magnetic chuck 16 atop of and secured to the work bed 14. As is conventional, the work bed 14 in the illustrated embodiment, is longitudinally and transversely adjustable with respect to the abrasive wheel 12, however, the abrasive wheel 12 could as well be longitudinally and transversely adjustable with respect to the work bed 14. In this respect, the surface grinder 10 and the means for adjusting the work bed or the abrasive wheel with respect to one another form no part of the present invention. In the illustrated embodiment, the work bed 14 is longitudinally adjustable within limits defined by the stops 19 and 20. A work piece 18 is supported on the magnetic chuck 16, by magnetizing the magnetic chuck 16 in a conventional fashion.

A refacer 22 exemplary of the present invention is illustrated affixed to the work bed 14 of the surface grinder 10. The refacer 22, as more particularly described below, includes a diamond bit support 24 which is permanently or removably affixed to the magnetic chuck 16, and a gauge assembly 26 which is removably secured to the magnetic chuck 16, by the action or operation of the magnetic chuck 16. Normally, preferably and advantageously, the diamond bit support 24 is permanently affixed to the work bed 14 or the magnetic chuck 16 secured thereto, and the gauge assembly 26 is secured to the magnetic chuck 16 by the operation of the latter, only when it is desired to reface or dress the abrasive wheel 12, all as more particularly described below.

More particularly, as can be best seen in FIGS. 2-5, the diamond bit support 24 comprises a mounting head 31 which is of a generally rectangular construction having a bore 32 formed therein for slidably receiving therethrough a diamond bit 28. The mounting head 31 can be fixedly secured to the magnetic chuck 16 by means of set screws 33 and 34 or the like, with the mounting head 31 being positioned such that the diamond bit 28 projects from the mounting head 31 perpendicular to the surface of the magnetic chuck 16.

The mounting head 31 preferably is fabricated from steel and a portion of its side wall can be cut away to provide a finger cavity 36 for convenience in slidably positioning the diamond bit 28 within the bore 32 in the mounting head 31. The diamond bit 28 can have a guide slot 29 formed in its peripheral surface, and a set screw 30 extends through the mounting head 31 and into the guide slot 29, for both aligning the diamond bit 28 and for releasably locking the diamond bit 28 in a preestablished vertically disposed position, as described more fully below.

Figure 2:
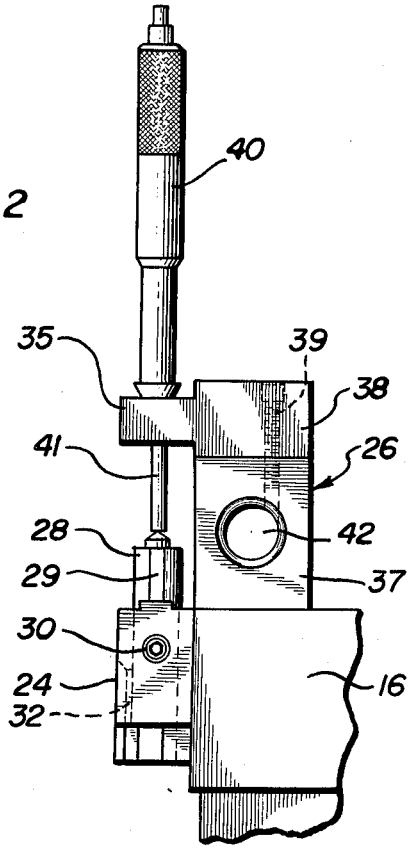
FIG. 2 is a partial side plan view illustrating the refacer attached to the surface grinder and further illustrating the manner in which the diamond bit thereof is set for control of depth of abrasive removal during refacing or redressing.
Figure 4:
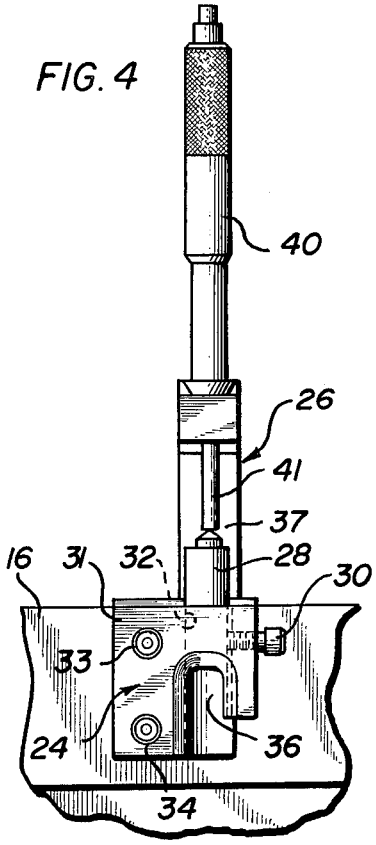
FIG. 4 is a front plan view of the refacer, as illustrated in FIG. 2.

The gauge assembly 26 is a generally rectangular-shaped member having an offset portion 35 which supports a micrometer 40. The arrangement is such that the plunger 41 of the micrometer 40 is vertically disposed above and aligned with the tip of the diamond bit 28 when the gauge assembly 26 is secured atop the magnetic chuck 16, as illustrated in FIGS. 2 and 4. While the gauge assembly 26 can be of a one piece construction, in the illustrated embodiment, the gauge assembly 26 is formed of a generally rectangular-shaped base portion 37 and a head portion 38 having the offset portion 35 formed as an integral part thereof. The base portion 37 and the head portion 38 are fixedly secured together by means of a set screw 39. Also, the base portion 37 has an aperture 42 extending transversely through it, for reasons set forth more specifically below.

Now that the construction of the grinding wheel retracer 22 has been described, the method in which it can be used to maximize its advantages in dressing or refacing an abrasive wheel and, more particularly, in dressing or refacing an abrasive wheel to grind a work piece to a finished size, can be described as follows. First of all, the gauge assembly 26 is positioned on the magnetic chuck 16 of the surface grinder 10, such that the plunger 41 of the micrometer 40 is vertically aligned with the diamond bit 28, as illustrated in FIGS. 2 and 4. The gauge assembly 26 then is fixedly secured in position, by energizing the magnetic chuck 16 in the conventional fashion. At this time, a work piece such as the work piece 18 need not be removed from the magnetic chuck 16, however, it can be removed if desired. Once the gauge assembly 26 is magnetically secured to the magnetic chuck 16, as described above, the micrometer 40 is manipulated in a wellknown fashion, to extend or retract the plunger 41 so that the distance between its terminal end and the surface of the magnetic chuck 16 corresponds to the desired finish size of the work piece 18. After having set the micrometer 40 to the desired finish dimension of the work piece 18, the set screw 30 is loosened and the diamond bit 28 is vertically raised so that the diamond on its terminal end abuts against the terminal end of the plunger 41. The set screw 30 then is tightened, to lock the diamond bit in this position. The diamond bit 28 can be conveniently raised and lowered within the bore 32 by extending a finger through the finger cavity 36 in the mounting head 31.

Figure 3:
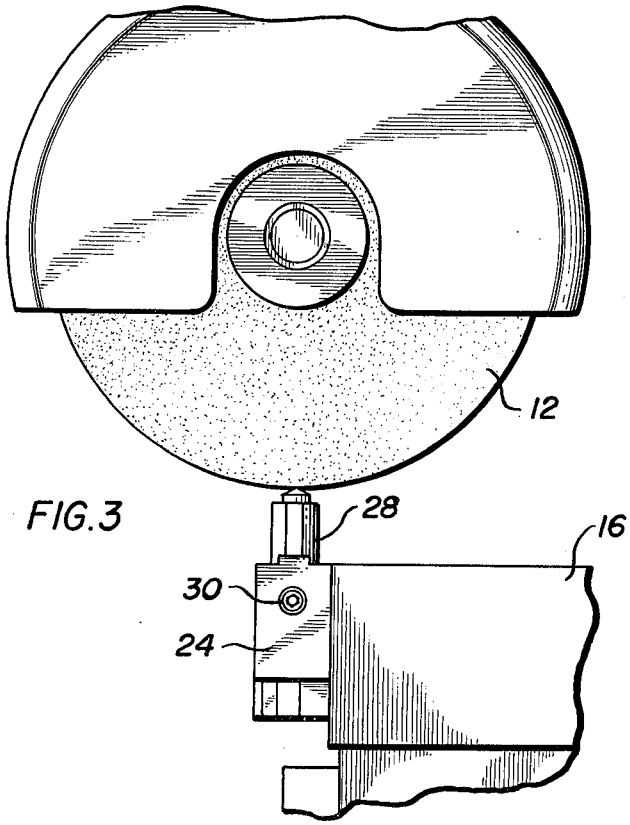
FIG. 3 is a partial side plan view of the surface grinder, illustrating the manner in which the abrasive wheel is refaced or dressed.
Figure 5:
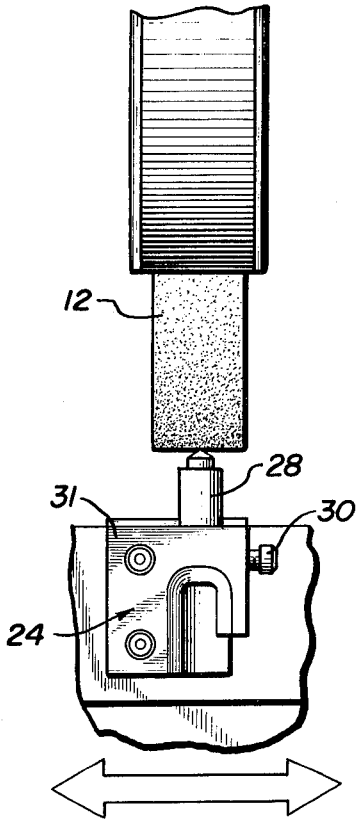
FIG. 5 is a partial front plan view of the surface grinder illustrating the manner in which the abrasive wheel is refaced or dressed.

Now, it is obvious that the distance from the surface of the magnetic chuck 16 to the tip of the diamond bit 28 now is the same as the desired finished dimension of the work piece 18. The magnetic chuck 18 is de-energized and the gauge assembly 26 is removed from the magnetic chuck 16. After removing the gauge assembly 26, the work bed 14 of the surface grinder 10 is longitudinally adjusted to engage the stops 19 and 20, in which position the axis of the abrasive wheel 12 will be positionally aligned with the vertical axis of the diamond bit 28, as illustrated in FIG. 3. The abrasive wheel 12 now can be dressed or refaced by operating the surface grinder to rotate the abrasive wheel 12 and to transversely adjust the work bed 14 with respect to the abrasive wheel 12, as generally illustrated in FIG. 5, and in conventional fashion. Obviously, the depth of abrasive removal during refacing or redressing must be such that sufficient abrasive material is removed so that the entire peripheral surface of the abrasive wheel 12, after dressing or refacing, corresponds to the dimensional position of the tip of the diamond bit 28.

When the abrasive wheel 12 has been dressed or refaced in the above-described fashion, the feed slip ring of the surface grinder 10 is adjustably positioned to zero, in the normal and conventional fashion. Now, during operation of the surface grinder 10 in grinding the work piece 18, when the gauge on the feed slip ring of the surface grinder 10 indicates zero, the work piece 18 has been ground to its desired dimension. Normally, preferably and advantageously, during the grinding operation, the abrasive wheel is adjusted such that it is approximately 0.003 above zero to allow for heat expansion during grinding.

On grinding the work piece 18 or other subsequent work pieces, if it is necessary or desirable to again redress or reface the abrasive wheel 12, the above outlined procedures are again followed.

Accordingly, from the above description, it can be seen that the abrasive wheel of a surface grinder can be easily and quickly refaced. More particularly and more importantly, the abrasive wheel can be refaced to grind one or more work pieces to a finished size, more accurately and more consistently from first to last work piece, regardless of the number of work pieces required. Further still, semi-skilled labor can be used to maintain accuracy in finishing of the finished work pieces.

In FIGS. 6–9, there is illustrated a grinding wheel refacer including a bit extension 43 and a gauge assembly extension 44, for use in those cases where the dimensional size of the work piece is such that the diamond bit 28 is positioned a substantial distance above the surface of the magnetic chuck 16 during refacing, to provide additional support for the diamond bit 28.

More particularly, as can be seen, the bit extension 43 is removably secured to the mounting head 31 by means of, for example, a set screw 52. For ease in aligning the bit extension with the mounting head 31, the respective ones of them can be provided with complimentary tongue and groove arrangement. The bit extension 43 is provided with a bore 54 for slidably receiving therein the diamond bit 28, as described above with respect to the mounting head 31. Also, a portion of the side wall of the bit extension 43 can be cut away to provide a finger cavity 55 for adjustably positioning the diamond bit 28 within the bore 54. The bit extension 43 also can be provided with an additional set screw 56 for locking the diamond bit 28 in position within the bit extension 43. Preferably and advantageously, the diamond bit 28 is of a sufficient length to extend through the bit extension 43 and into and possibly through the mounting block 31 to increase its lateral support within the bit extension 43 and the mounting block 31. Also, in this fashion, the diamond bit 28 can be lockingly secured therein by means of both the set screw 56 and the set screw 30.

The gauge assembly extension 44 is of a generally rectangular construction and has at least one or more apertures such as the aperture 57 formed in it, for receiving a portion of a coupler 45, for securing the gauge assembly 26 atop the gauge assembly extension 44, as more fully described below.

Figure 6:
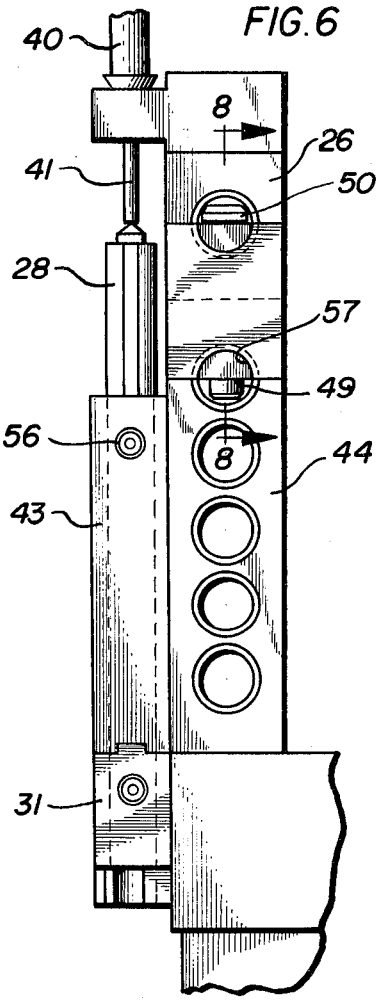
FIG. 6 is a partial side plan view illustrating a refacer constructed in accordance with a second embodiment of the invention.
Figure 7:
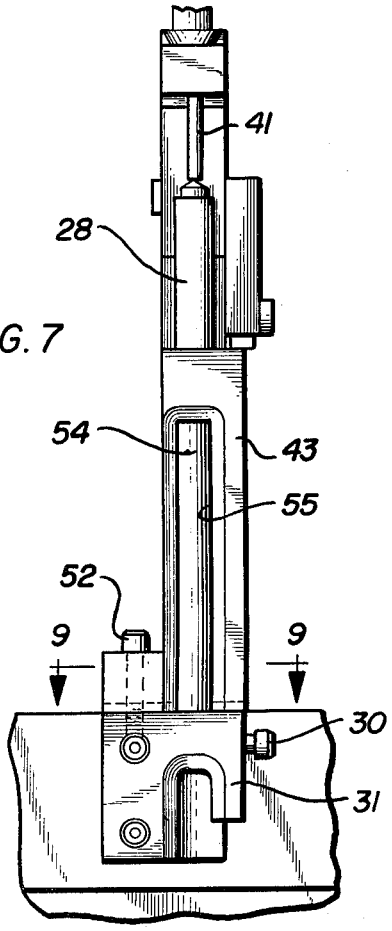
FIG. 7 is a partial front plan view of the refacer as illustrated in FIG. 6.
Figure 8:
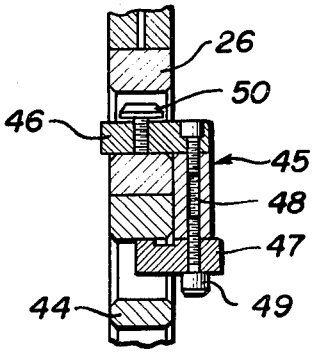
FIG. 8 is a partial sectional view illustrating the manner in which the gauge assembly and the gauge assembly extension are fixedly coupled together.
Figure 9:
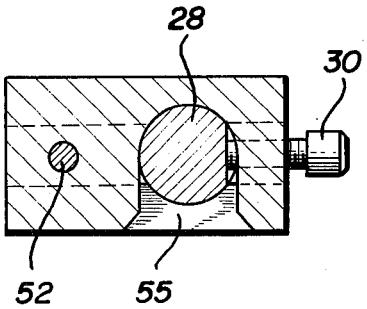
FIG. 9 is a sectional view taken along lines 9-9 of FIG. 7.

More particularly, as can be best seen in FIGS. 6 and 8, the coupler 45 includes an upper block 46 and a lower block 47 which are proportioned to be slidably received within the respective apertures 42 and 57. A threaded screw 48 is extended through the upper block 46 and the lower block 47, and a threaded nut 49 is provided on the threaded screw 48. The gauge assembly 26 is affixed to the gauge assembly extension 44 by extending the upper block 46 through the aperture 42 in it and by extending the lower block 47 through the aperture 57 in the gauge assembly extension 44 and by tightening the nut 49 to thus effectively clamp the gauge assembly 26 to the gauge assembly extension 44, as illustrated in FIGS. 6 and 8. A threaded screw 50 can be extended through the upper block 46 to bear on the surface of the aperture 42 in the gauge assembly 26, to provide additional securement of the coupler 45 to the gauge assembly 26 and the gauge assembly extension 44.

After the bit extension 43 is connected with the mounting block 31, and the gauge assembly 26 is coupled to the gauge assembly extension 44, the dressing wheel refacer can be used in the manner described above, to reface an abrasive wheel.

It will thus be seen that the objects set forth above, among those made apparent from the preceding description, are efficiently attained and certain changes may be made in the above construction. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A grinding wheel refacer for use in combination with grinding apparatus having an abrasive wheel and a work bed supporting a magnetic chuck; a diamond bit; mounting means fixedly secured to said work bed and adjustably supporting said diamond bit in refacing relationship with said abrasive wheel, said mounting means comprising a mounting head having a bore extending through it, said diamond bit being slidably adjustably disposed within said bore, a finger cavity in communication with said bore, whereby said diamond bit can be adjustably positioned within said bore by extending a finger through said finger cavity to engage said diamond bit, and means for positionally locking said diamond bit at an established position within said bore; a gauge assembly comprising a generally rectangular-shaped member having an offset portion for supporting therein a micrometer means, said gauge assembly being removably secured to said magnetic chuck by the operation of the latter and supporting said micrometer means in operative relationship with said diamond bit such that said diamond bit can be adjustably positioned to engage said micrometer means, said micrometer means being adjustable to establish a fixed determinable dimensional relationship with respect to a work piece to be ground; whereby said diamond bit can be adjustably positioned to reface an abrasive wheel such that the radius of the peripheral face of said abrasive wheel corresponds to the finished dimension of the work piece.

2. The grinding wheel refacer of claim 1, further comprising a bit extension adapted to be removably secured to said mounting means, said bit extension having a bore formed in it for slidably adjustably receiving therein said diamond bit, and means for lockingly securing said diamond bit in an adjusted position within said bore in said bit extension; a gauge assembly extension adapted to be removably secured to said gauge assembly; and coupling means for removably securing said gauge assembly and said gauge assembly extension to one another.

3. The grinding wheel refacer of claim 2, wherein said gauge assembly and said gauge assembly extension both have an aperture formed in them, said coupler means comprising a pair of blocks adapted to extend into said apertures and threaded means for securing said pair of blocks together in a fashion such as to clamp said gauge assembly and said gauge assembly extension to one another.

* * * * *